US012607021B2

(12) United States Patent
Risi

(10) Patent No.: US 12,607,021 B2
(45) Date of Patent: Apr. 21, 2026

(54) SLIP-RESISTANT FLOOR FOR A CARGO-CARRYING APPARATUS

(71) Applicant: SOCIÉTÉ EN COMMANDITE PROLAM, Cap St-Ignace (CA)

(72) Inventor: Benoît Risi, Cap St-Ignace (CA)

(73) Assignee: Société En Commandite Prolam

( * ) Notice: Subject to any disclaimer, the term of this patent is extended or adjusted under 35 U.S.C. 154(b) by 0 days.

(21) Appl. No.: 16/441,443

(22) Filed: Jun. 14, 2019

(65) Prior Publication Data

US 2019/0383029 A1 Dec. 19, 2019

Related U.S. Application Data

(60) Provisional application No. 62/684,930, filed on Jun. 14, 2018.

(51) Int. Cl.
*E04F 15/02* (2006.01)
*E04F 15/04* (2006.01)

(52) U.S. Cl.
CPC ..... *E04F 15/02172* (2013.01)

(58) Field of Classification Search
CPC ..... E04F 15/02172; E04F 15/048
USPC ..... 52/177
See application file for complete search history.

(56) References Cited

U.S. PATENT DOCUMENTS 1,185,445 A * 5/1916 Name not available ..... E04F 15/10 52/177
1,407,679 A * 2/1922 Ruthrauff ..... E04F 15/04 52/480
1,441,197 A * 1/1923 Kent ..... B29C 66/1142 156/264
1,649,842 A * 11/1927 Mcbride ..... E04F 15/04 52/302.3
1,788,432 A * 1/1931 Jaspert ..... E04F 15/20 404/47
2,106,399 A * 1/1938 Beaumont ..... B60R 3/00 52/177
2,114,450 A * 4/1938 Maclean ..... E04F 13/147 52/541
2,280,071 A * 4/1942 Hamilton ..... E04F 15/04 52/578

(Continued)

FOREIGN PATENT DOCUMENTS

CH 707738 A2 * 9/2014 ..... E04F 15/082
CN 107313574 A * 11/2017

(Continued)

OTHER PUBLICATIONS

ESPACE.com translation of Heinrich et al. patent DE 10233021 A1 created 2020 merged with original document and relied upon during prosecution filename "DE10233021A1_ESPACE_BIB_AND_TRANSLATION.pdf" (Year: 2020).*

*Primary Examiner* — Patrick J Maestri
*Assistant Examiner* — Joseph J. Sadlon
(74) *Attorney, Agent, or Firm* — Wood, Phillips, Katz, Clark & Mortimer

(57) ABSTRACT

A cargo-carrying apparatus and a floor for a cargo-carrying apparatus, the floor comprising: a floor body having a top floor surface; and a slip-resistant layer extending partially over the top floor surface such that the top floor surface includes at least one covered portion covered by the slip-resistant layer and at least one uncovered portion adjacent the at least one covered portion.

14 Claims, 5 Drawing Sheets

(56) References Cited

U.S. PATENT DOCUMENTS 2,512,310 A * 6/1950 Corson ..... A47G 27/0231 15/215
2,531,659 A * 11/1950 Watson ..... A47L 23/24 428/44
D179,858 S * 3/1957 Moor, Jr. ..... D6/583
3,420,015 A * 1/1969 Costanzo, Jr. ..... E04C 2/423 52/180
3,578,375 A * 5/1971 Finefrock ..... B60R 13/01 52/177
3,599,385 A * 8/1971 LaRue ..... E04F 15/04 52/471
3,707,060 A * 12/1972 Jansen, Jr. ..... E04B 2/825 52/749.1
3,761,336 A * 9/1973 Quinif ..... E04C 2/24 428/56
3,868,798 A * 3/1975 Spica ..... E04F 15/105 52/177
3,895,981 A * 7/1975 Tesch ..... E04F 11/163 52/181
3,936,551 A * 2/1976 Elmendorf ..... B32B 21/08 52/309.3
3,950,908 A * 4/1976 Van Eyk ..... E01C 13/045 52/436
4,137,356 A * 1/1979 Shoemaker ..... B60B 39/12 248/346.11
4,361,614 A * 11/1982 Moffitt, Jr. ..... A47G 27/0212 428/44
4,388,788 A * 6/1983 Bosco ..... E04C 2/12 52/390
4,406,099 A * 9/1983 Barrett ..... E04F 15/166 52/127.3
4,415,616 A * 11/1983 Angioletti ..... E04F 13/0862 428/326
4,555,292 A * 11/1985 Thompson ..... E04F 15/02 404/19
4,555,886 A * 12/1985 Wiechowski ..... A01K 1/0151 156/309.6
4,596,729 A * 6/1986 Morrison ..... E04F 15/02161 428/44
4,885,882 A * 12/1989 Forshee ..... B63B 3/48 52/177
4,907,387 A * 3/1990 Turnbull ..... E04F 15/02183 52/177
5,018,695 A * 5/1991 Bishop ..... B32B 7/02 248/346.11
5,070,664 A * 12/1991 Groh ..... B32B 27/304 52/177
5,157,804 A * 10/1992 Williams ..... A47L 23/26 15/161
5,194,308 A * 3/1993 Chang ..... B32B 7/12 428/44
5,243,804 A * 9/1993 Therrien ..... E04C 2/423 15/215
5,331,701 A * 7/1994 Chase ..... A61G 3/067 14/71.1
5,351,458 A * 10/1994 Lehe ..... A01K 1/015 52/177
5,419,618 A * 5/1995 Hatcher ..... A47C 16/025 297/423.46
5,461,836 A * 10/1995 Yang ..... E04F 11/16 52/312
5,472,767 A * 12/1995 Neubauer ..... B44C 5/043 428/113
5,513,472 A * 5/1996 Olsen ..... A47L 23/24 52/177
D370,817 S * 6/1996 Reardon ..... D6/582
5,587,218 A * 12/1996 Betz ..... A47G 27/0293 15/215
5,645,912 A * 7/1997 Nelson ..... E04F 11/163 52/188
5,722,711 A * 3/1998 German ..... B60R 13/0206 296/39.2
5,744,220 A * 4/1998 Ringo ..... B44C 5/0469 428/195.1
5,778,609 A * 7/1998 Pawson ..... A47L 23/26 15/238
5,807,021 A * 9/1998 Aaron ..... B60B 39/12 238/14
5,815,995 A * 10/1998 Adam ..... A47L 23/24 52/177
5,840,396 A * 11/1998 Betz ..... A47G 27/0293 428/67
5,928,735 A * 7/1999 Padmanabhan .... B62D 25/2054 428/297.4
5,968,625 A * 10/1999 Hudson ..... B32B 21/13 428/106
5,985,398 A * 11/1999 Bellegarde ..... E04F 15/04 52/177
6,082,061 A * 7/2000 Ryan ..... B29C 45/14 52/182
6,088,976 A * 7/2000 Roy ..... A47G 27/0287 52/180
6,108,992 A * 8/2000 Shaw ..... E04B 5/12 52/177
6,143,119 A * 11/2000 Seidner ..... B44C 1/26 144/350
6,162,270 A * 12/2000 Nystrom ..... B05B 14/468 55/385.2
6,214,428 B1 * 4/2001 Henderson ..... B27M 3/0046 238/14
6,318,794 B1 * 11/2001 Berube ..... B32B 21/08 296/181.2
6,372,323 B1 * 4/2002 Kobe ..... B25G 1/10 4/581
6,564,397 B1 * 5/2003 Hawley ..... A47K 3/002 4/580
6,635,331 B2 * 10/2003 Kessler ..... A47L 23/26 428/100
6,694,682 B2 * 2/2004 Fanti ..... B32B 3/14 52/177
6,699,575 B1 * 3/2004 Dagher ..... B32B 5/14 428/114
6,718,714 B1 * 4/2004 Montgomery, Sr. ..... F24D 13/022 52/177
6,740,380 B2 * 5/2004 Kessler ..... A47L 23/24 428/45
6,844,058 B2 * 1/2005 Blum ..... A47L 23/22 15/104.002
6,898,911 B2 * 5/2005 Kornfalt ..... B32B 27/04 52/468
6,921,502 B1 * 7/2005 Nord ..... A47L 23/24 264/257
7,147,907 B1 * 12/2006 Hiltz ..... B32B 3/04 52/716.2
7,300,032 B2 * 11/2007 Williams ..... F16F 1/3737 248/346.01
7,303,801 B2 * 12/2007 Kessler ..... A47L 23/26 15/215
7,441,378 B2 * 10/2008 Wood ..... E04F 15/02 52/177
7,452,433 B2 * 11/2008 Shin ..... A01K 1/0157 156/71
7,503,146 B2 * 3/2009 Thomas ..... E04F 15/02183 52/177
7,520,092 B2 * 4/2009 Showers ..... E04F 15/10 52/177
7,571,573 B2 * 8/2009 Moller, Jr. ..... E01C 5/20 472/92
7,617,641 B2 * 11/2009 Landey ..... E04B 9/345 52/302.1
7,625,625 B2 * 12/2009 Rios ..... B32B 27/20 156/60
7,793,469 B2 * 9/2010 Murphy, Jr. ..... B29C 65/56 52/177
7,823,332 B2 * 11/2010 Siegel ..... A47G 27/0287 52/177

(56) References Cited

U.S. PATENT DOCUMENTS 7,832,044 B2 * 11/2010 Kessler ..... A47L 23/266 15/217
8,230,654 B2 * 7/2012 McIntosh ..... E04F 15/043 52/177
8,291,670 B2 * 10/2012 Gard ..... E04C 2/42 52/662
8,302,337 B2 * 11/2012 Savagian ..... B32B 27/08 52/177
8,359,794 B2 * 1/2013 Biro ..... E04F 19/04 52/177
8,403,592 B2 * 3/2013 Son ..... A01G 20/00 404/35
8,534,009 B2 * 9/2013 Kay ..... E04F 11/166 52/28
8,535,785 B2 * 9/2013 Masanek, Jr. ..... E01C 13/045 428/140
8,726,577 B2 * 5/2014 Whiting ..... E06C 7/006 256/25
8,993,098 B2 * 3/2015 Masanek, Jr. ..... B29C 45/34 264/273
9,114,307 B1 * 8/2015 Rittenberry ..... A63C 19/00
9,121,186 B2 * 9/2015 Mensah ..... E04F 11/17
9,169,656 B2 * 10/2015 Thornton ..... E04F 15/225
D744,119 S * 11/2015 Umbriac ..... A47L 23/266 D25/158
9,255,405 B2 * 2/2016 Pervan ..... B32B 27/04
9,376,823 B1 * 6/2016 Thiers ..... E04F 15/02038
9,434,421 B1 * 9/2016 Lu ..... B65D 90/026
9,506,257 B2 * 11/2016 Bennett ..... A63B 69/02
D783,294 S * 4/2017 Ellis ..... D5/53
9,643,377 B2 * 5/2017 Song ..... B32B 37/182
9,714,513 B2 * 7/2017 Hamp ..... B32B 37/04
9,731,160 B2 * 8/2017 Inzer ..... A63B 71/1225
9,744,753 B2 * 8/2017 Sheffield ..... B29C 70/78
9,788,674 B2 * 10/2017 Pacione ..... E04F 15/02
9,809,982 B2 * 11/2017 Randjelovic ..... E04F 15/02038
9,816,271 B2 * 11/2017 Dombowsky ..... E04B 5/43
9,975,605 B2 * 5/2018 Westin ..... B32B 21/10
9,981,608 B1 * 5/2018 DoVale ..... B60D 1/58
10,011,998 B1 * 7/2018 Dantzer ..... E04F 15/02044
10,081,165 B2 * 9/2018 Padmanabhan ..... B32B 3/14
10,214,914 B2 * 2/2019 Bachelder ..... E04F 15/02038
D845,648 S * 4/2019 Zhu ..... D5/59
10,398,245 B2 * 9/2019 Prest ..... E04F 11/175
10,526,797 B2 * 1/2020 Song ..... B32B 5/26
10,577,804 B1 * 3/2020 Waites ..... E04F 11/175
D883,346 S * 5/2020 Pier ..... D15/32
10,676,938 B2 * 6/2020 Winter ..... E04F 11/002
10,681,994 B2 * 6/2020 Van Ceulebroeck ..... A47F 5/16
10,953,931 B2 * 3/2021 Gillin ..... B62D 25/2054
11,149,452 B2 * 10/2021 Rus ..... E04G 21/30
2002/0139070 A1 * 10/2002 Berndt, Jr. ..... E04F 15/02166 52/177
2003/0170452 A1 * 9/2003 Hansen ..... B05B 12/24 428/343
2003/0196387 A1 * 10/2003 Hussey ..... E04G 21/30 52/3
2004/0038062 A1 * 2/2004 Wilson ..... B27K 3/15 428/528
2005/0158501 A1 * 7/2005 O'Connor ..... E04F 11/104 428/95
2006/0179733 A1 * 8/2006 Padmanabhan ..... B32B 27/20 52/177
2006/0265975 A1 * 11/2006 Geffe ..... E04F 15/10 52/177
2007/0042159 A1 * 2/2007 Sugihara ..... E04F 15/185 428/156
2007/0193179 A1 * 8/2007 Risi ..... B32B 3/12 52/591.4
2007/0199271 A1 * 8/2007 Little ..... E04F 13/042 52/514
2013/0111836 A1 * 5/2013 Masanek, Jr. ..... E01C 5/226 52/302.1
2014/0017452 A1 * 1/2014 Pervan ..... B44C 1/24 427/510
2014/0318047 A1 * 10/2014 Mensah ..... E04F 11/17 29/428
2014/0325934 A1 * 11/2014 Eversley ..... C09J 7/21 442/151
2014/0335319 A1 * 11/2014 Tsai ..... A63B 21/4037 428/172
2016/0201339 A1 * 7/2016 Daley ..... C09J 7/20 156/60
2017/0367513 A1 * 12/2017 Loegering ..... B32B 21/08 296/181.2
2018/0195292 A1 * 7/2018 Morris ..... B32B 13/00
2018/0347192 A1 * 12/2018 Hartman ..... E04F 15/02038
2019/0203480 A1 * 7/2019 Garbelotto ..... E04F 15/04

FOREIGN PATENT DOCUMENTS

DE 10233021 A1 * 1/2004 ..... E04F 15/10
DE 10260605 A1 * 7/2004 ..... A47B 96/205
DE 102005059382 B4 * 7/2008 ..... E04F 15/048
EP 0611201 A1 * 8/1994 ..... A47G 27/0231
EP 1854920 A2 * 11/2007 ..... E04F 15/02
GB 2339437 A * 1/2000 ..... E01C 5/001
JP 4070789 B2 * 4/2008 ..... E04F 15/048
KR 20130033626 A * 4/2013 ..... E04F 15/02172
WO WO-9734064 A1 * 9/1997 ..... B32B 21/08
WO WO-9817447 A1 * 4/1998 ..... B27M 3/0053
WO WO-03105654 A1 * 12/2003 ..... A47G 27/0231
WO WO-2006114586 A1 * 11/2006 ..... E04F 15/02172
WO WO-2008061332 A1 * 5/2008 ..... B27M 3/0053
WO WO-2013116997 A1 * 8/2013 ..... E04F 15/02172

* cited by examiner

SLIP-RESISTANT FLOOR FOR A CARGO-CARRYING APPARATUS

CROSS-REFERENCE TO RELATED APPLICATION

The present application claims priority from U.S. Provisional Patent Application No. 62/684,930, filed on Jun. 14, 2018, the entire specification of which is incorporated herein by reference.

TECHNICAL FIELD

The technical field generally relates to slip-resistant floors for cargo carrying apparatuses, and more precisely to floors for cargo carrying apparatuses having a slip-resistant layer.

BACKGROUND

Commercial goods are often transported in specialized containers such as truck bodies, dry vans, intermodal and marine containers or the like. The floors of these containers are usually made from wood and/or wood products such as wood planks or engineered wood such as laminated wood, plywood, etc.

It is usually desirable to have a floor with a relatively high coefficient of friction to prevent goods received in the container from slipping on the floor and moving inside the container as the container is transported. A high coefficient of friction may also prevent a worker loading and unloading goods from the container, or otherwise performing maintenance in the container, from slipping and potentially injuring himself.

To enhance the coefficient of friction of a floor, some floors are provided with a slip-resistant coating layer such as a polyurethane-based (PUR) coating layer which extends over a top surface of the floor and covers the entire top surface of the floor.

These types of coating layers are further waterproof or at least water-resistant such that they are not liable to be washed away by water. When applied uniformly on the top surface of the floor, the coating layer may further create a watertight barrier which is impervious to water such that it prevents water from passing through to the wooden floor beneath the coating layer. In theory, this type of coating layer could further preserve the floor, since wood and wood products are susceptible to water and humidity, which can damage the floor and thereby reduce its lifespan.

Unfortunately, over time, the coating layer may become worn or damaged. More specifically, the coating layer may become chipped or scratched, which could provide an opening through which water and humidity may seep in, but which may not be large enough to allow water and humidity to properly exit the floor. The water or humidity may therefore become trapped into the floor and damage the floor as described above.

There is therefore a need for a floor which will overcome at least one of the above-identified drawbacks.

SUMMARY

According to one aspect, there is provided a floor for a cargo-carrying apparatus, the floor comprising: a floor body having a top floor surface; and a slip-resistant layer extending partially over the top floor surface such that the top floor surface includes at least one covered portion covered by the slip-resistant layer and at least one uncovered portion adjacent the at least one covered portion.

In at least one embodiment, the slip-resistant layer includes a slip-resistant coating layer made from a coating substance.

In at least one embodiment, the coating substance includes a polyurethane-based composition.

In at least one embodiment, the polyurethane-based composition includes a polyurethane hot melt material.

In at least one embodiment, the coating substance includes an epoxy-based composition.

In at least one embodiment, the slip-resistant coating layer has a rough texture.

In at least one embodiment, the slip-resistant coating layer is water-resistant to prevent the slip-resistant coating layer from being damaged by water.

In at least one embodiment, the slip-resistant layer includes at least one piece of slip-resistant material secured to the top floor surface over the at least one covered portion.

In at least one embodiment, the at least one covered portion has a first surface area and the at least one uncovered portion has a second surface area, the second surface area being substantially smaller than the first surface area.

In at least one embodiment, the first surface area corresponds to about 60% of a total surface area of the top floor surface and the second surface area corresponds to about 40% of the total surface area of the top floor surface.

In at least one embodiment, the at least one covered portion has a first surface area and the at least one uncovered portion has a second surface area, the second surface area being substantially equal to the first surface area.

In at least one embodiment, the at least one uncovered portion includes at least one uncovered stripe.

In at least one embodiment, the at least one uncovered stripe includes a first uncovered stripe, a second uncovered stripe spaced from the first uncovered stripe and a third uncovered stripe located between the first and second uncovered stripes.

In at least one embodiment, the first, second and third uncovered stripes extend parallel to each other.

In at least one embodiment, the at least one covered portion includes a first covered stripe extending between the first and third uncovered stripes and a second covered stripe extending between the second and third uncovered stripes.

In at least one embodiment, all of the at least one uncovered stripes have a same width.

In at least one embodiment, the floor body includes at least one laminated floor panel.

In at least one embodiment, each laminated floor panel includes a plurality of elongated wood pieces disposed side-by-side and extending parallel to each other.

In at least one embodiment, the floor body includes a plurality of fastener holes, each fastener hole being sized and shaped for receiving a fastener for fastening the floor to the cargo-carrying apparatus, the fastener holes being located only in the at least one uncovered portion of the top floor surface.

According to another aspect, there is also provided a cargo-carrying apparatus comprising: a floor for receiving cargo thereon, the floor including: a floor body having a top floor surface; and a slip-resistant layer extending partially over the top floor surface such that the top floor surface includes at least one covered portion covered by the slip-resistant coating layer and at least one uncovered portion adjacent the at least one covered portion.

DETAILED DESCRIPTION

Figure 1:
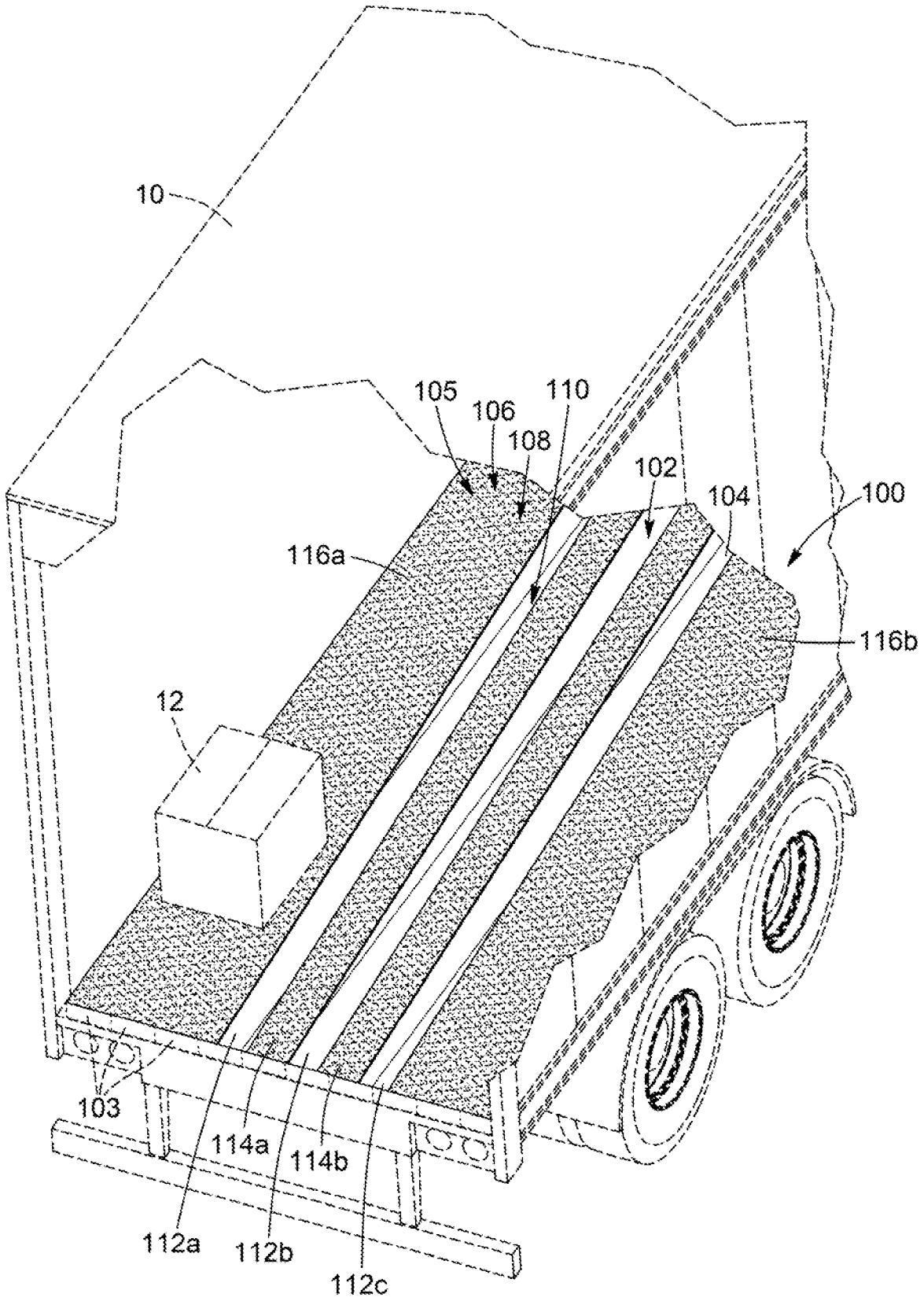
FIG. 1 is a top perspective view of a portion of a floor for a cargo-carrying apparatus with a slip-resistant coating layer applied on a top floor surface of the floor, in accordance with one embodiment, in which the slip-resistant layer defines adjacent uncovered and covered stripes on the top floor surface.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

For the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "top", "bottom", "forward", "rearward" "left", "right" and the like should, unless otherwise indicated, be taken in the context of the figures and correspond to the position and orientation in the floor and corresponding parts when being used. Positional descriptions should not be considered limiting.

Figure 2:
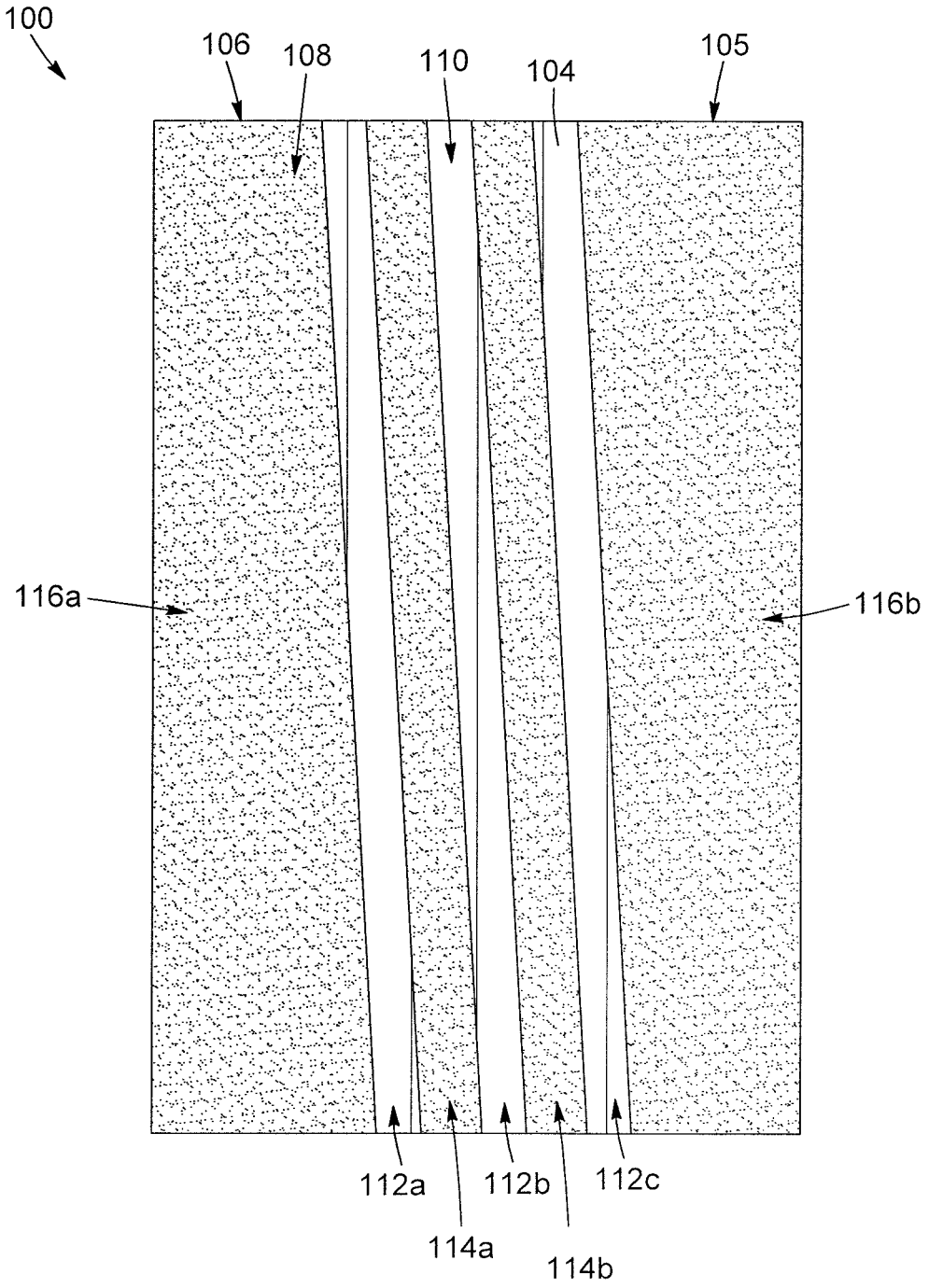
FIG. 2 is a top plan view of the portion of the floor illustrated in FIG. 1.

Referring to FIGS. 1 and 2, there is shown a portion of a floor 100 for use in a cargo-carrying apparatus 10, in accordance with one embodiment. The floor 100 is configured for receiving goods 12 transported using the cargo-carrying apparatus 10. The cargo-carrying apparatus 10 may include a container, a trailer, a truck body, or any other powered or unpowered cargo-carrying apparatuses for which the use of the present floor 100 may be appropriate.

The floor 100 includes a generally flat floor body 102 having a bottom floor surface, not shown, and a top floor surface 104 opposite the bottom floor surface. In the illustrated embodiment, the floor body 102 includes at least one rectangular laminated floor panel made of a plurality of elongated wood pieces 103 disposed side-by-side and extending parallel to each other. The elongated wood pieces 103 are joined together to form the rectangular laminated floor panel.

In the illustrated embodiment, the floor 100 further includes a slip-resistant layer 105 which is adapted to enhance the coefficient of friction of the top floor surface 104 and thereby improves traction for loading equipment such as forklifts and for workers walking on the floor 100.

In the embodiment illustrated in FIGS. 1 and 2, the slip-resistant layer 105 includes a coating layer 106 made of a coating substance which has been applied on the top floor surface 104. More specifically, the coating substance may be provided in a fluid form to allow it to be applied to the top floor surface 104, and then cured by letting it dry over a period of time or using other curing techniques such as exposure to ultraviolet light or the like.

The coating substance may be applied such that the coating substance, when solidified, has a relatively rough texture which enhances the coefficient of friction of the top floor surface 104. The coating substance may further be selected such that it forms a coating layer 106 which is water-resistant. In this embodiment, the coating layer 106 is not liable to be washed away by water, which thereby substantially prevents water from damaging the coating layer 106.

In one embodiment, the coating material includes a polyurethane-based composition, and more specifically a polyurethane hot melt material. Alternatively, the coating material may include an epoxy-based composition, or any other coating material that a skilled person would consider to be suitable to form an adequate slip-resistant layer.

In some circumstances, when applied to the top floor surface 104 in a certain manner and/or such that the coating layer 106 has a certain thickness, the coating material may form a coating layer 106 which is impervious to water. If the entire top floor surface 104 was covered by the coating layer 106, the floor body 102 would therefore be substantially encased or encapsulated in a layer which is impervious to water. If the coating layer 106 layer was chipped, scratched or otherwise damaged, a relatively small opening may be created. This opening would allow water and/or humidity to seep in to the floor body 102 but would not be large enough to properly let the water and humidity exit the floor body 102, thereby allowing the moisture content of the floor body to increase over time which would negatively impact the mechanical properties of the floor 100.

To alleviate this concern and ensure that the floor body 102 does not become encased or encapsulated in a layer impervious to water, the coating layer 106 does not cover the entire top floor surface 104 but instead extends partially over the top floor surface 104 according to a predetermined pattern. Specifically, the top floor surface 104 includes at least one covered or coated portion 108 which is covered by the coating layer 106 and at least one uncovered or uncoated portion 110 adjacent the at least one coated portion 108, as shown in FIGS. 1 and 2. In this configuration, regardless of whether or not the coating layer 106 is applied in such a way that it is impervious to water, there will always remain at least one portion of the top floor surface 104 which is uncoated and therefore through which water and/or humidity which has entered the floor body 102 can escape from the floor body 102.

In the illustrated embodiment, the at least one uncoated portion 110 includes a plurality of spaced-apart, parallel stripes 112*a*, 112*b*, 112*c*. Specifically, the at least one uncoated portion includes a first uncoated stripe 112*a*, a second uncoated stripe 112*b* spaced from the first uncoated stripe 112*a* and a third uncoated stripe 112*c* located generally midway between the first and second uncoated stripes 112*a*, 112*b*. In this embodiment, the at least one coated portion 108 includes a first coated stripe 114*a* extending between the first and third uncoated stripes 112*a*, 112*c* and a second coated stripe 114*b* extending between the second and third uncoated stripes 112*b*, 112*c*. The at least one coated portion 108 further includes a first continuous coated area 116*a* adjacent the first uncoated stripe 112*a* and a second continuous coated area 116*b* adjacent the second uncoated stripe 112*b*. As shown in FIGS. 1 and 2, the first and second coated stripes 114*a*, 114*b* are therefore parallel to each other and also parallel to the first, second and third uncoated stripes 112*a*, 112*b*, 112*c*.

In the illustrated embodiment, the first, second and third uncoated stripes 112*a*, 112*b*, 112*c* and the first and second coated stripes 114*a*, 114*b* all generally have the same width. Alternatively, the first, second and third uncoated stripes 112*a*, 112*b*, 112*c* and/or the first and second coated stripes could have different widths 114*a*, 114*b*.

Still in the illustrated embodiment, the first, second and third uncoated stripes 112*a*, 112*b*, 112*c* are slightly angled relative to the elongated wood pieces 103 of the laminated floor panel. Alternatively, the first, second and third uncoated stripes 112*a*, 112*b*, 112*c* could instead extend generally parallel to the wood pieces 103 of the laminated floor panel. In yet another embodiment, the uncoated stripes 112*a*, 112*b*, 112*c* could instead extend generally perpendicularly to the wood pieces 103 of the laminated floor panel.

Figure 3:
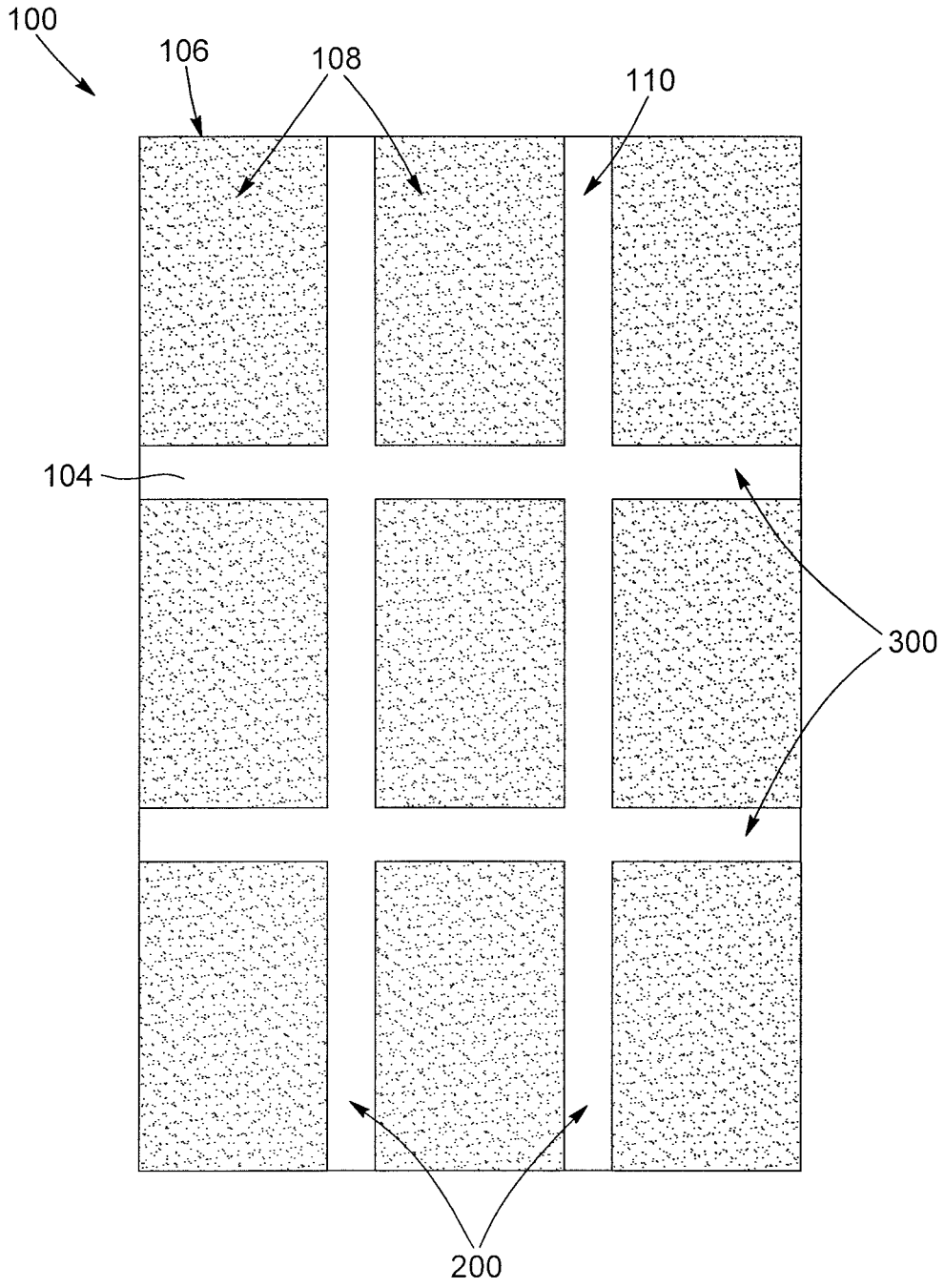
FIG. 3 is a top plan view of a portion of a floor for a cargo-carrying apparatus with a slip-resistant layer applied on a top floor surface of the floor, in accordance with another embodiment, in which the slip-resistant layer defines a grid pattern on the top floor surface.

It will be understood that alternatively, the coating layer 106 could be applied to the top floor surface 104 in accordance with another pattern such that the at least one uncoated portion 110 is shaped differently. For example, FIG. 3 shows the coating layer 106 applied to the top floor surface 104 in accordance with an alternative pattern. In this embodiment, the at least one uncoated portion 110 includes a first plurality of uncoated stripes 200 and a second plurality of uncoated stripes 300 extending perpendicularly to the first plurality of uncoated stripes 200. The first and second pluralities of uncoated stripes 200, 300 thereby together form an uncoated grid-shaped portion in the top floor surface 104.

Figure 4:
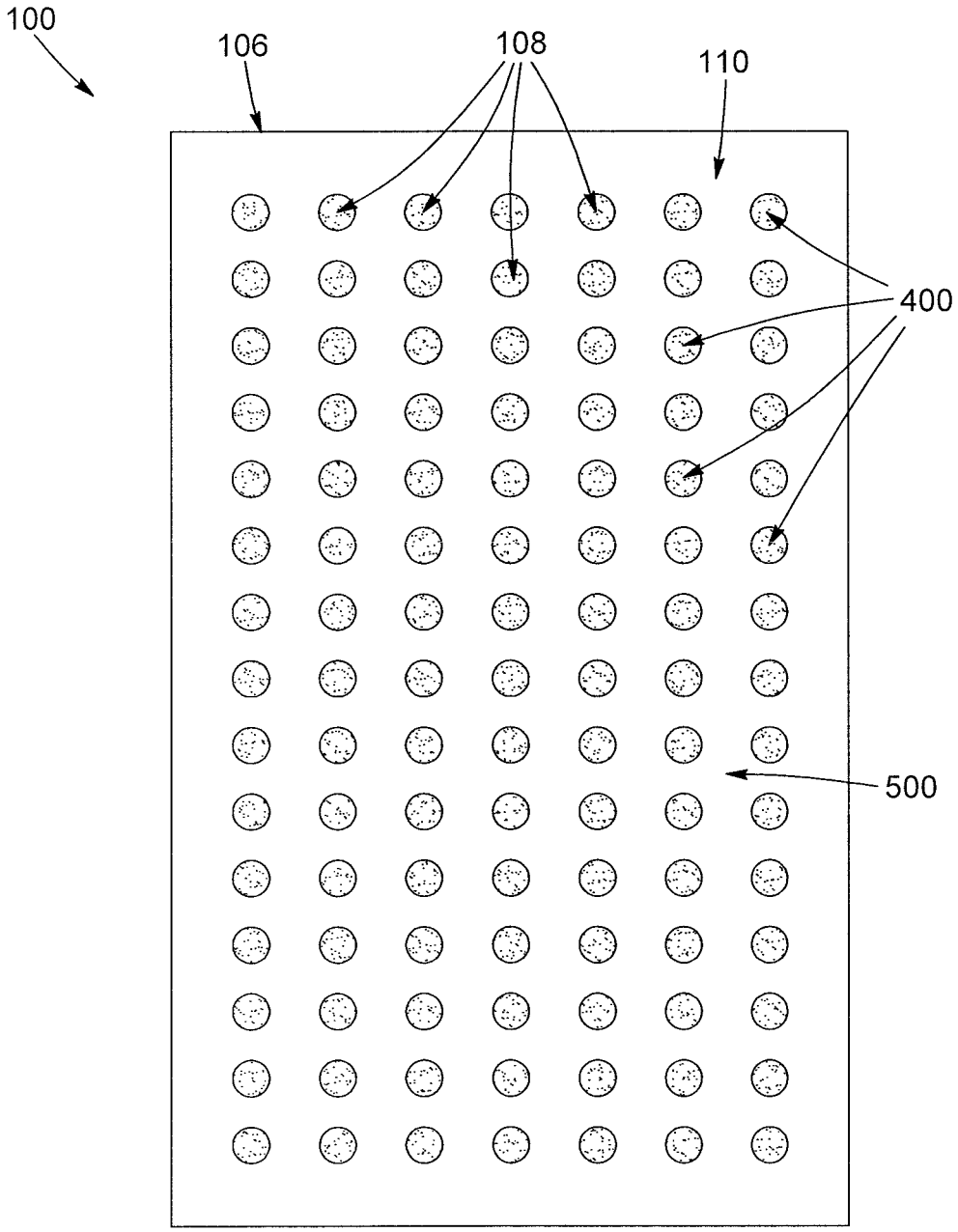
FIG. 4 is a top plan view of a portion of a floor for a cargo-carrying apparatus with a slip-resistant coating layer applied on a top floor surface of the floor, in accordance with yet another embodiment, in which the slip-resistant layer defines a dotted pattern on the top floor surface.

FIG. 4 shows another example in which the coating layer 106 is applied to the top floor surface 104 according to a repeating pattern. In this embodiment, the at least one coated portion 108 includes a plurality of circular coated portions 400 which are spaced from each other and the at least one uncoated portion 110 includes an uncoated portion 500 which extends between the circular coated portions 400 and is therefore adjacent to the circular coated portions 400.

Alternatively, instead of being circular, each coated portion 400 could have another shape such as a rectangular shape, a linear shape or the like. In another embodiment, the coating layer 106 could be applied to the top floor surface 104 in accordance with any other suitable pattern and the at least one uncoated portion 110 may be shaped according to any other shape which a skilled person would consider to be appropriate.

In one embodiment, the coated portion 108 has a first surface area and the uncoated portion 110 has a second surface area which is substantially smaller than the first surface area. For example, the first surface area of the coated portion 108 could correspond to about 60% of a total surface area of the top floor surface 104, and the second surface area of the uncoated portion 110 could correspond to about 40% of a total surface area of the top floor surface 104. In another embodiment, the first surface area of the coated portion 108 could be substantially smaller than the second surface area of the uncoated portion 110. For example, the first surface area of the coated portion 108 could correspond to about 40% of a total surface area of the top floor surface 104, and the second surface area of the uncoated portion 110 could correspond to about 60% of a total surface area of the top floor surface 104. In yet another embodiment, the first surface area of the coated portion 108 and the second surface area of the uncoated portion 110 could be substantially equal to each other.

It will be understood that in the above-described embodiments, even though the coated portions 108 do not extend over the entire top floor surface 104, the coated portions 108 still cover an area of the top floor surface which is large enough to provide adequate slip-resistant properties to the top floor 104. The top floor surface 104 coated with a coating layer 106 having coated portions 108 and uncoated portions 110, as described above, could therefore provide substantially the same slip-resistant properties than if the entire top floor surface 104 was coated, while reducing the costs of manufacturing the floor 100 since less coating material is needed than if the entire top floor surface 104 was coated.

It will be appreciated that the coating layer 106 described above may be applied to the top floor surface 104 using any technique which a skilled person would consider to be appropriate.

It will be understood that the above-described embodiments are provided as examples only, and that various alternative embodiments may be considered. In yet another embodiment, the slip-resistant layer may be made of any other types of material which, when applied or secured to the top floor surface 104, would form a slip-resistant layer on the top floor surface 104.

Figure 5:
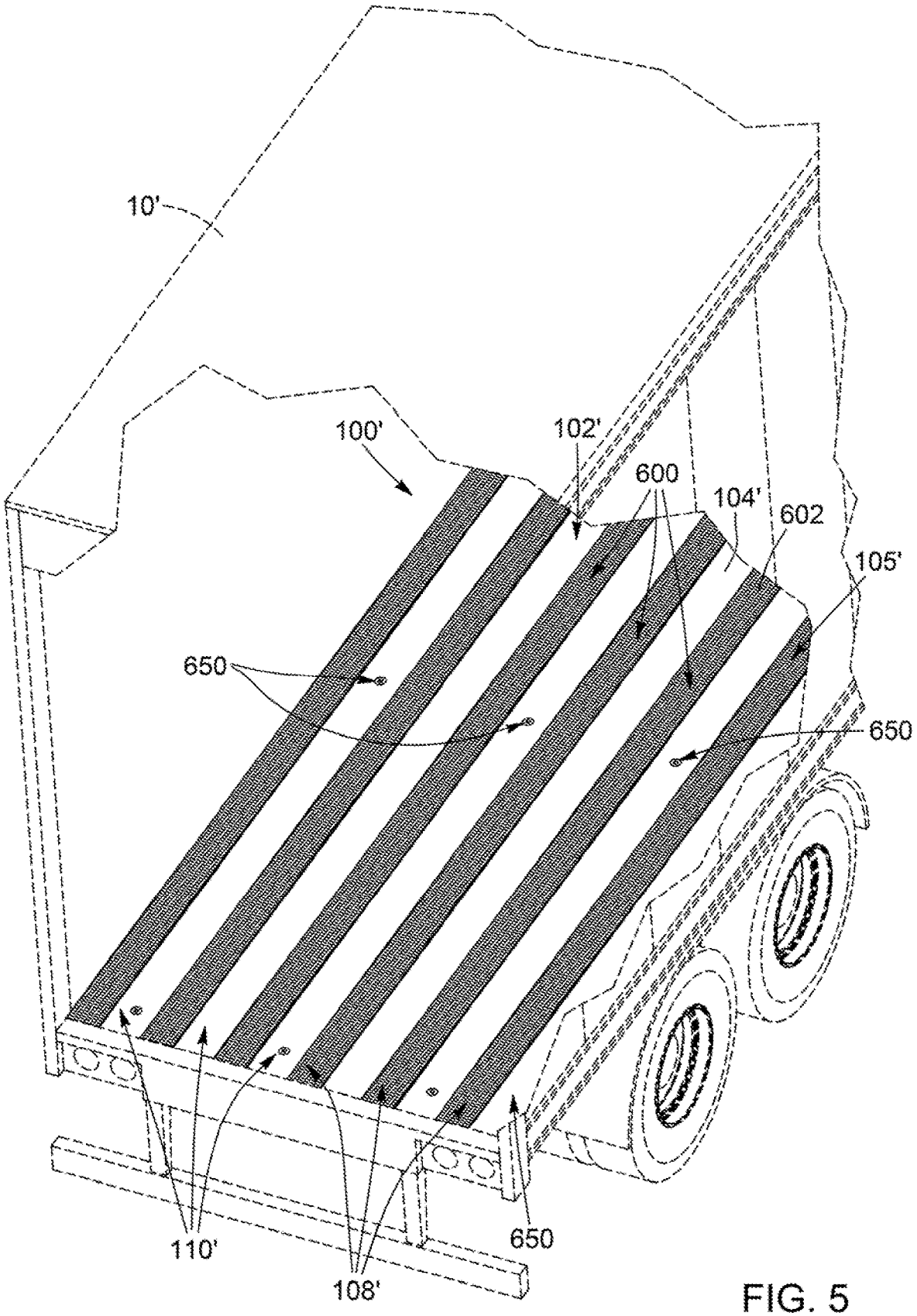
FIG. 5 is a top perspective view of a portion of a floor for a cargo-carrying apparatus with a slip-resistant layer extending on a top floor surface of the floor, in accordance with still another embodiment, in which the slip-resistant layer include a plurality of slip-resistant material pieces secured to the top floor surface.

For example, FIG. 5 shows a floor 100' for a cargo-carrying apparatus 10', in accordance with another embodiment. Similarly to the floor 100 illustrated in FIGS. 1 and 2, the floor 100' includes a floor body 102' having a top floor surface 104' and a slip-resistant layer 105' extending partially over the top floor surface 104'. Also similarly to the floor 100 illustrated in FIGS. 1 and 2, the slip-resistant layer 105' extends only partially over the top floor surface 104'. More specifically, the top floor surface 104' includes a plurality of covered portions 108' which are covered by the slip-resistant layer 105' and a plurality of uncovered portions 110' which are not covered by the slip-resistant layer 105' and which are located adjacent the covered portions 108'.

In this embodiment, instead of being made from a coating substance applied to the top floor surface 104', the coating layer 105' includes a plurality of slip-resistant material pieces 600 secured to the top floor surface 104'. Specifically, each slip-resistant material piece 600 is elongated and has a bottom face, not shown, secured to the top floor surface 104' and a top face 602 opposite the bottom face. The bottom face may be secured to the top floor surface 104' using an adhesive or using any other securing technique which a skilled person would consider to be suitable. The top face 602 is configured to have slip-resistant properties. Specifically, each slip-resistant material piece 600 may include a strip of sandpaper, a substantially thin strip of metal such as aluminum or steel or of rigid plastic polymer having a raised diamond pattern or a similar embossed pattern defined on the top face 602, a piece of elastomeric material such as synthetic rubber, a piece of slip-resistant film or tape, a strip of melamine panel, or may include any other material having a coefficient of friction which is substantially higher than a coefficient of friction of the top floor surface 104'.

In the embodiment illustrated in FIG. 5, the elongated strips of material 602 are disposed parallel to each other and are spaced from each other. In this configuration, the portions of the top floor surface 104' on which the slip-resistant material pieces 600 are disposed define the covered portions 108' of the top floor surface 104', while the uncovered portions 110' are defined between the slip-resistant material pieces 600. This configuration therefore defines alternating uncovered and covered stripes 112', 114' on the top floor surface 104'. In the illustrated embodiment, the uncovered and covered stripes 112', 114' have substantially the same width. In this configuration, the covered portions 108' and the uncovered portions 110' have substantially the same surface area on the top floor surface 104'.

The floor 100' may also be secured to a cargo-carrying apparatus using a plurality of fasteners. Specifically, the floor body 102' may include a plurality of fastener holes 650, each fastener hole 650 being sized and shaped for receiving a fastener. As shown in FIG. 5, the fastener holes 650 may be located only in the uncovered portions 110' of the top floor surface 104' to thereby avoid damaging the covered portions 108' and provide a more aesthetically pleasing appearance to the floor 100'. It will be understood that this could also apply to the floor 100 illustrated in FIGS. 1 and 2, which could be secured to the cargo-carrying apparatus using fasteners received in a plurality of fastener holes located only in the uncoated portions 110.

Alternatively, the fastener holes 650 could be distributed between the covered portions 108' and the uncovered portions 110'.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A floor for a container, comprising:

a plurality of wood pieces disposed side-by-side that define a top floor surface;

a first portion of the wood pieces being covered by a thin cured liquid coating to define a watertight slip-resistant layer that inhibits liquid water from passing through to the wood pieces;

a second portion of the top floor surface being uncovered by the cured liquid coating and adapted such that moisture within the wood pieces can escape therefrom to inhibit the moisture content of the wood pieces from increasing over an extended time;

the first portion defining between about 40% to about 60% of a total surface area of the top floor surface;

the second portion defining between about 60% to about 40% of the total surface area of the top floor surface; and wherein the slip-resistant layer of the first portion and the uncovered second portion are substantially coplanar.

2. The floor as claimed in claim 1, wherein the coating includes a polyurethane-based composition.

3. The floor as claimed in claim 2, wherein the polyurethane-based composition includes a polyurethane hot melt material.

4. The floor as claimed in claim 1, wherein the coating includes an epoxy-based composition.

5. The floor as claimed in claim 1, wherein the slip-resistant layer has a rough texture.

6. The floor as claimed in claim 1, wherein the slip-resistant layer is water-resistant to prevent the slip-resistant layer from being damaged by water.

7. The floor as claimed in claim 1, wherein the first portion and second portion define surface areas that are substantially equal to each other.

8. The floor as claimed in claim 1, wherein the at least one uncovered portion includes at least one uncovered stripe.

9. The floor as claimed in claim 8, wherein the at least one uncovered stripe includes a first uncovered stripe, a second uncovered stripe spaced from the first uncovered stripe and a third uncovered stripe located between the first and second uncovered stripes.

10. The floor as claimed in claim 9, wherein the first, second and third uncovered stripes extend parallel to each other.

11. The floor as claimed in claim 10, wherein the at least one covered portion includes a first covered stripe extending between the first and third uncovered stripes and a second covered stripe extending between the second and third uncovered stripes.

12. The floor as claimed in claim 11, wherein all of the at least one uncovered stripes have a same width.

13. The floor as claimed in claim 1, wherein the floor body includes at least one laminated floor panel.

14. The floor as claimed in claim 1, wherein the floor defines a plurality of fastener holes, each fastener hole being sized and shaped for receiving a fastener for fastening the floor to the container, the fastener holes being located only in the at least one uncovered second portion.

* * * * *